US006827019B1

(12) United States Patent
Hieronymus et al.

(10) Patent No.: US 6,827,019 B1
(45) Date of Patent: Dec. 7, 2004

(54) RUBBER BLANKET WITH REGISTER CUT-OUTS, AND METHOD OF ALIGNING A RUBBER BLANKET

(75) Inventors: Jens Hieronymus, Darmstadt (DE); Frank Kropp, Mauer (DE); Jürgen Rothaug, Nussloch (DE); Frank Schaum, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 345 days.

(21) Appl. No.: 09/694,569

(22) Filed: Oct. 23, 2000

(30) Foreign Application Priority Data

Oct. 21, 1999 (DE) ..... 199 50 605

(51) Int. Cl.[7] ..... B41L 3/02; B41F 1/28

(52) U.S. Cl. ..... 101/486; 101/383; 101/415.1

(58) Field of Search ..... 101/378, 382.1, 101/383, 415.1, 485, 486

(56) References Cited

U.S. PATENT DOCUMENTS

| | | | | |
|---|---|---|---|---|
| 3,384,014 A | | 5/1968 | Berg | |
| 4,068,587 A | | 1/1978 | Bollmer | |
| 4,467,722 A | * | 8/1984 | Klingelhoefer et al. | 101/383 |
| 4,688,483 A | * | 8/1987 | Schollenberger | 101/378 |
| 4,707,902 A | * | 11/1987 | Kunkel et al. | 29/407.09 |
| 4,977,833 A | * | 12/1990 | Inage et al. | 101/378 |
| 5,088,408 A | * | 2/1992 | Philpot | 101/378 |
| 5,094,164 A | * | 3/1992 | Kowalczyk et al. | 101/401.1 |
| 5,127,327 A | | 7/1992 | Philpot | |
| 5,370,051 A | * | 12/1994 | Schild et al. | 101/383 |
| 5,562,039 A | * | 10/1996 | Fox et al. | 101/378 |

FOREIGN PATENT DOCUMENTS

| | | |
|---|---|---|
| DE | 649 279 | 8/1937 |
| DE | 34 37 309 A1 | 4/1986 |
| DE | 35 45 172 A1 | 7/1987 |
| DE | 42 14 207 C1 | 7/1993 |
| DE | 42 39 089 A1 | 11/1993 |
| DE | 94 16 007.4 U1 | 2/1995 |
| DE | 199 00 565 A1 | 7/2000 |
| EP | 0 761 436 A1 | 3/1997 |
| GB | 2 145 973 A | 4/1985 |

* cited by examiner

*Primary Examiner*—Ren Yan
(74) *Attorney, Agent, or Firm*—Laurence A. Greenberg; Werner H. Stemer; Ralph E. Locher

(57) ABSTRACT

A method of aligning a rubber blanket formed with register cut-outs, relative to a clamping device having register pins, for clamping the rubber blanket onto a cylinder, includes bringing the register cut-outs formed in the rubber cylinder into contact with the register pins of the clamping device when the clamping device has been applied to the cylinder.

14 Claims, 2 Drawing Sheets

RUBBER BLANKET WITH REGISTER CUT-OUTS, AND METHOD OF ALIGNING A RUBBER BLANKET

BACKGROUND OF THE INVENTION

FIELD OF THE INVENTION

The invention relates to a rubber blanket with register cut-outs, and a method of aligning a rubber blanket, more particularly, formed with register cut-outs, relative to a clamping device having register pins, for clamping the rubber blanket onto a cylinder.

Such a method is described in the published German Patent Document DE 35 45 172 A1, corresponding to U.S. Pat. No. 4,707,902, wherein, initially, the ends of a rubber blanket formed with register cut-outs are inserted between clamping bars in a clamping device outside of a printing machine until the register cutouts come into contact with register pins belonging to the clamping devices. The clamping bars of the clamping devices are then connected by clamping screws, The clamping devices with the rubber blanket are then applied to a cylinder in the printing machine.

This method is unsuitable for printing or varnishing machines having clamping devices which are permanently arranged on the cylinder and which serve to fasten a printing plate to the cylinder. Because of the high flexural rigidity of printing plates, they are required to be rolled onto the cylinder, as described, for example, in the published German Patent Document DE 42 14 207 C1, for which purpose clamping devices applied permanently to the cylinder are used.

A rubber blanket corresponding to the rubber blanket generally described in the introduction hereto and in greater detail in the aforementioned published German Patent Document DE 35 45 172 A1 does indeed permit the alignment thereof in-register for cut-out in-line varnishing, but is unfavorable from several points of view because the register cut-outs are introduced directly into the soft blanket material.

On the one hand, the dimensional stability of the register cut-outs is very low. For example, distortion of the register cut-outs cannot be ruled out during frequently repeated fastening of the rubber blanket or because of swelling of the rubber. In addition, the risk exists that cracks will form at the register cut-outs as a result of careless handling of the rubber blanket.

On the other hand, the easily deformable register cut-outs require that the delicate ends of the blanket be aligned and firmly clamped very carefully outside the machine.

In addition, the published German Utility-Model Document DE 94 16 007 U1 describes a rubber blanket having a clamping bar which, in a construction as a flat profile, is vulcanized together with the rubber blanket only on the upper side of the blanket, so that the clamping bar ends flush with an edge of the rubber blanket. The design of the rubber blanket is unfavorable from various points of view.

On the one hand, the rubber blanket is unsuitable for cut-out in-line varnishing because this requires the top rubber layer of the rubber blanket to be cut out in locations corresponding to the varnishing cut-outs, as is extensively described in the aforementioned published German Patent Document DE 35 45 172 A1. Because the rubber blanket does not have any register cut-outs, cutting out the cut-outs in-register is possible only within the printing machine, which is very awkward to do.

On the other hand, the rubber blanket having the clamping bar formed as a flat profile assumes the presence of a clamping device having a maximum opening width, between a clamping pad and a clamping jaw, that is greater than the thickness of the blanket material together with the thickness of the clamping bar connected to the blanket material. Clamping devices which can be closed by rotating a slightly eccentric shaft do not always have such a large opening width, however.

SUMMARY OF THE INVENTION

It is accordingly an object of the invention to provide an improved method of aligning a rubber blanket having register cut-outs, and to provide such a rubber blanket which is particularly well suited for performing the method.

With the foregoing and other objects in view, there is consequently provided, in accordance with one aspect of the invention, a method of aligning a rubber blanket formed with register cut-outs, relative to a clamping device having register pins, for clamping the rubber blanket onto a cylinder, which comprises bringing the register cut-outs formed in the rubber cylinder into contact with the register pins of the clamping device when the clamping device has been applied to the cylinder.

In accordance with another aspect of the invention, there is provided a rubber blanket having register cut-outs and being formed of blanket material, comprising a clamping bar of the rubber blanket, the cut-outs being formed in the clamping bar.

In accordance with a further feature of the invention, the clamping bar is disposed only on an underside of the blanket material.

In accordance with an added feature of the invention, the clamping bar projects beyond an edge of the blanket material.

In accordance with an additional feature of the invention, the edge is a leading edge of the blanket material.

In accordance with yet another feature of the invention, the register cut-outs are formed only in the clamping bar.

In accordance with yet a further feature of the invention, the rubber blanket includes a sealing substance provided in at least one corner angle between the blanket material and the clamping bar.

In accordance with yet an added feature of the invention, the rubber blanket includes a clamping device, only the clamping bar being grippable by the clamping device for fastening the rubber blanket to a cylinder.

In accordance with a third aspect of the invention, there is provided a rubber blanket comprising structures defining register cut-outs, the register cut-outs being arranged in the rubber blanket so as to correspond to register cut-outs formed in a printing plate.

In accordance with a fourth and a fifth aspect of the invention, there are provided a printing machine and a varnishing machine, respectively, having a rubber blanket with register cut-outs and being formed of blanket material, the rubber blanket comprising a clamping bar, and the cut-outs being formed in the clamping bar.

Thus, the method according to the invention calls for bringing the register cut-outs in contact with the register pins when the clamping device is applied or fitted to a cylinder.

This method is extremely well suited for printing or by varnishing machines having clamping devices permanently arranged on the cylinder, the clamping devices hating been originally provided only for fastening a printing plate, and being now also selectively used for fastening the rubber blanket. In the method according to the invention, the actions of aligning the register cut-outs in relation to the register pins, and firmly clamping the rubber blanket are performed within the printing or varnishing machine.

The rubber blanket according to the invention is distinguished by the fact that the register cut-outs are introduced into a clamping bar belonging to the rubber blanket.

In this rubber blanket, high dimensional stability of the register cut-outs is assured, which means that multiple in-register clamping of the rubber blanket is possible over a long service life. The clamping bar can be formed as a hard metal strip or plastic strip. For example, in a construction as an aluminum strip, the clamping bar is eminently practical. In order to align the rubber blanket, the register cut-outs introduced into the clamping bar can be brought into engagement with register pins of a clamping device applied or fitted to a cylinder.

In an embodiment which is advantageous with regard to the register cut-outs striking the register pin without tilting, the clamping bar or strip is arranged on the rear side of the blanket material of the rubber blanket, i.e., that side thereof which faces the cylinder and is formed, for example, of a fabric. When the clamping bar or strip is clamped into the clamping device, it therefore rests directly on a clamping pad belonging to the clamping device.

In an embodiment which is advantageous with regard to a clamping device having a small opening width, the clamping bar or strip projects beyond an end of the rubber-covered blanket material which is preferably located at the start of the print. When the rubber blanket is fastened to the cylinder by a clamping device, it is therefore merely necessary for the clamping bar or strip, and not the blanket material, to be inserted into the clamping device and firmly clamped by the latter. The thickness of the clamping bar or strip, which is about 0.3 mm, is several times less than the thickness of the blanket material which is about 2 mm. Because of this fact, the rubber blanket can even be clamped firmly in clamping devices having an opening width which is smaller than the thickness of the rubber blanket.

In an embodiment which is advantageous with regard to the economic production of the clamping bar or strip, only the clamping bar or strip and not the rubber-covered blanket material is provided with the register cut-outs. Although it is also conceivable to stamp the register cut-outs only through the clamping bar or strip or through both the clamping bar or strip and the blanket in the case of a clamping bar or strip that is already permanently connected to the blanket material, it is more beneficial to stamp the register cut-outs into the clamping bar or strip before the clamping bar or strip is connected to the flexible blanket material.

In an embodiment which is advantageous with regard to reducing the risk of the clamping bar or strip loosening or separating from the blanket material, vulcanizing or bonding gaps between the clamping bar or strip and the blanket material are sealed on the outside, for which purpose use can be made again of an adhesive which is already used for the large-area bonding of the clamping bar or strip to the blanket material, or a different adhesive provided specifically for the sealing. The adhesive is applied into the corner angle formed by the blanket material and the clamping bar or strip together, so that the corner angles are partially filled with a wedge of adhesive, and peeling of the soft blanket material off the clamping bar or strip is prevented absolutely reliably, even after a relatively long service time of the rubber blanket.

Sealing is advantageous not only in the case of the clamping bar or strip being connected to the blanket material by adhesive bonding but also in the case of a connection being made by vulcanizing the blanket material onto the clamping bar or strip. In addition to an adhesive or vulcanization bond between the clamping bar or strip and the blanket material, the formlocking connection thereof, for example by rivets, is also conceivable. In this regard, it is noted that a formlocking connection is one which connects two elements together due to the shape of the elements themselves, as opposed to a forcelocking connection, which locks the elements together by force external to the elements.

In an embodiment which is advantageous with regard to clamping the rubber blanket into a clamping device in an unyielding and therefore secure manner, only the clamping bar or strip, but not the soft blanket material, is clamped into the clamping device. Because only the flat sides of the clamping bar or strip and either the very soft rubber surface (upper side) nor the fabric surface (underside) of the blanket material are provided as areas for the action of a force or contact areas for the clamping device, there is o danger that there will be any clamping traces pressed persistently into the blanket material, which could have adverse effects upon renewed clamping, even after frequent clamping and unclamping. In addition, it has been shown that a highly permanent bonding of the clamping bar or strip to the blanket material is surprisingly able to withstand the shear loading resulting from the clamping force required to tension or tauten the rubber blanket.

In an embodiment which is advantageous with regard to the variable use of a printing or varnishing-machine cylinder comprising a clamping device with register pins, both the register cut-outs in the rubber blanket and the register cut-outs of a printing plate can be clamped onto the cylinder as a replacement for the rubber blanket and can be pushed in-register onto one and the same register pins belonging to the clamping device. The register cut-outs in the rubber blanket essentially correspond in terms of the shape thereof to the register cut-outs in the printing plate. For example, the center spacing of the register pins is exactly the same as the center spacing of the register cut-outs in the rubber blanket, and exactly the same as the center spacing of the register cut-outs in the printing plate. In the case of a printing plate which, if required, is clamped in register onto the cylinder and, for example, is formed as a flexographic printing plate, the latter can be used for very fine spot varnishing, for example contoured so as to correspond to a line of text. In the case of a rubber blanket, clamped in register onto the cylinder as required, this can be used for varnishing with simply contoured and, for example, rectangular varnishing cut-outs, for which purpose the uppermost rubber layer of the blanket material is cut out so as to coincide with the varnishing cut-outs. Of course, when a blanket is clamped on in the delivered state without making any subsequent cut-outs, the cylinder can also be used for full-surface varnishing and coating.

It is also noted that, in some cases, the register cut-outs in the rubber blanket arranged so as to correspond to the register cut-outs in the printing plate can be introduced into the soft blanket material of a rubber blanket which does not have a clamping bar or strip.

Other features which are considered as characteristic for the invention are set forth in the appended claims.

Although the invention is illustrated and described herein as embodied in a rubber blanket with register cut-outs, and a method of aligning a rubber blanket, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1A:
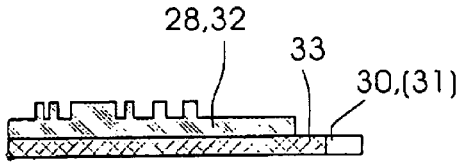
FIG. 1*a* is a fragmentary view of FIG. 1 showing part of the rubber blanket and of a printing plate clamped thereon.
Figure 1:
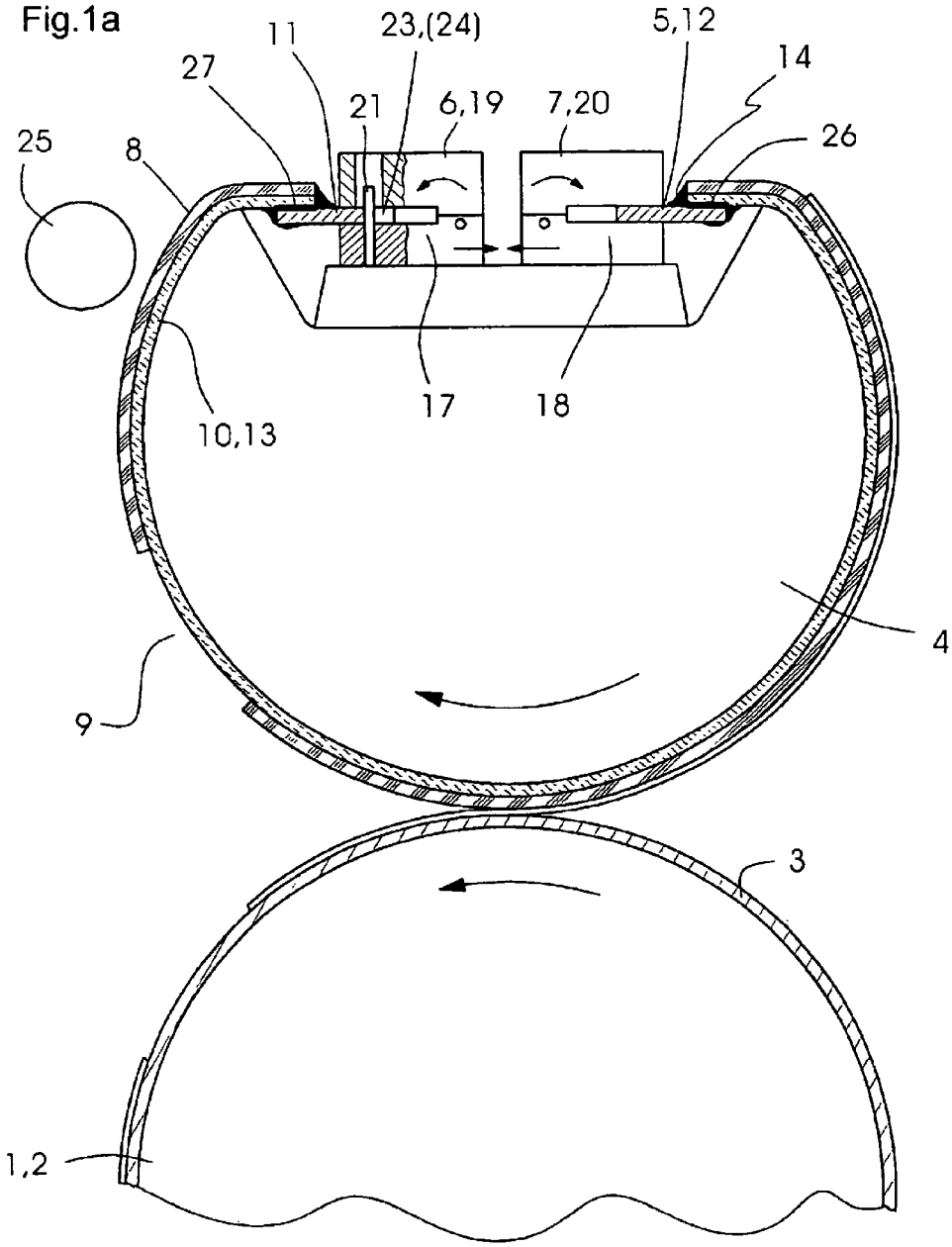
FIG. 1 is a fragmentary diagrammatic cross-sectional view of an offset printing unit of a rotary printing machine including a cylinder with a rubber blanket thereon.

Referring now to the drawings and, first, particularly to FIG. 1 thereof, there is shown therein one of a umber of offset printing units which may be included in a rotary printing machine. In FIG. 1, there is shown a varnishing unit arranged downline of the offset printing unit in the transport direction of the printing material, the varnishing unit including an impression cylinder 2 for transporting a sheet of printing material 3, and a cylinder 4 with a rubber blanket 5, which is fastened to the cylinder 4 by clamping devices 6 and 7.

The rubber blanket 5 includes an upper-side rubber layer 8 (note FIG. 3) which carries the varnish and from which at least one recess 9 for the cut-out in-line varnishing of the printing material 3 has been cut, and an underside fabric layer 10 and clamping bars 11 and 12, which are bonded to the fabric layer 10. Intermediate layers may also be disposed between the layers 8 and 10. The sheet-like composite material formed of at least the layers 8 and 10 are referred to hereinbelow as the blanket material 13.

The corner angles formed by the upper sides of the clamping bars 11 and 12 together with the arrow sides of the blanket material 13, and those formed by the arrow sides of the clamping bars 11 and 12 together with the underside of the blanket material 13, are provided, over the entire width of the rubber blanket 4 with applied seals 14 for which an adhesive different from that used for bonding the clamping bars 11 and 12 to the blanket material 13 has been used.

Figure 2:
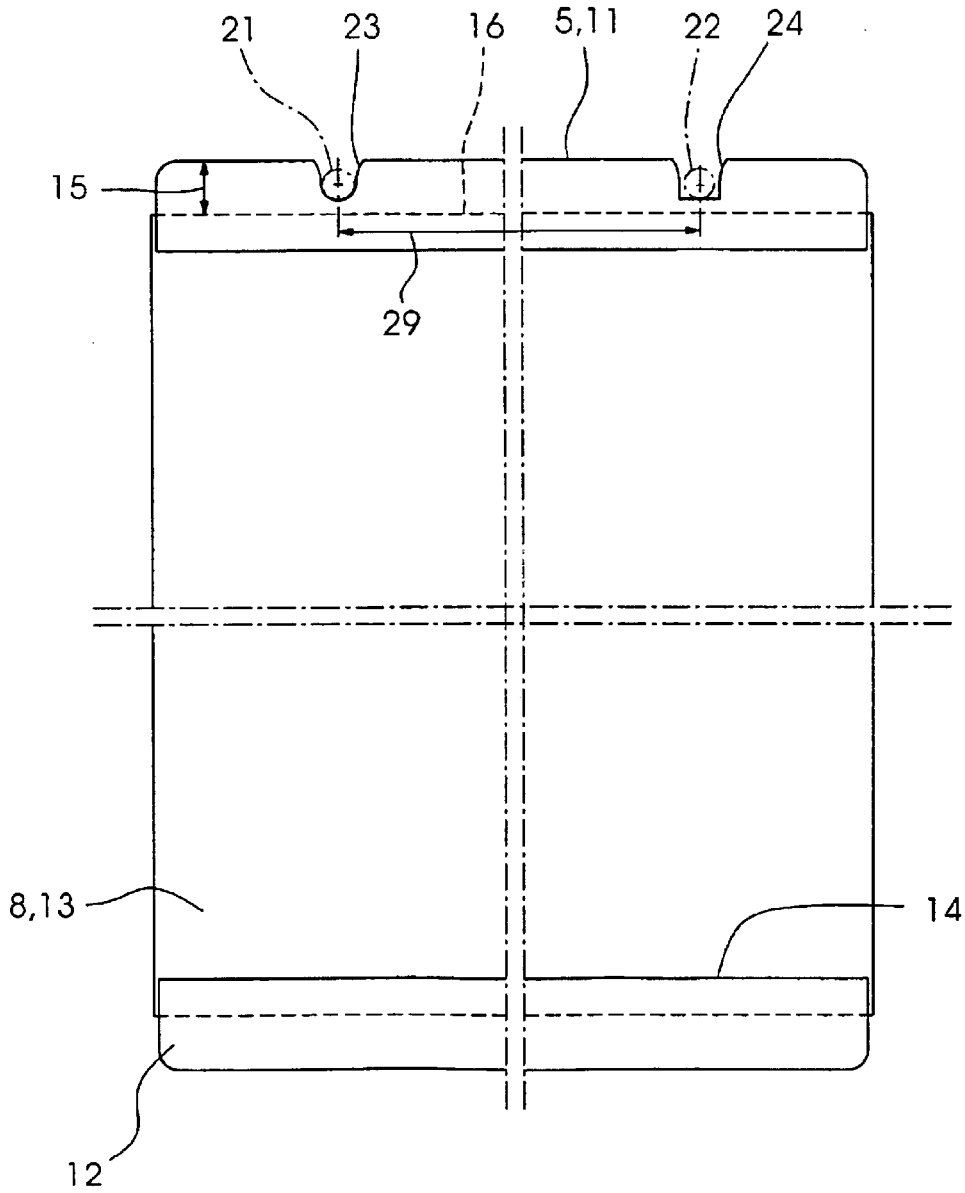
FIG. 2 is a top plan view of the rubber blanket after it has been removed from the cylinder.

The overall width of each clamping bar 11, 12 disposed on one side of the blanket material 13 is 2 to 3 cm and, as shown in FIG. 2, is subdivided into an overlap width 15 corresponding approximately to half the total width, by which each clamping bar 11, 12 projects beyond a corresponding edge 16 of the blanket material 13, and a remaining covering width over which each clamping bar 11, 12 is (nondestructively) inseparably connected to the blanket material 13.

Each of the clamping devices 6 and 7 belonging to a tensioning device for tensioning the rubber blanket 5 includes a respective clamping pad 17, 18 and a respective clamping jaw 19, 20 which is adjustable relative to the respective clamping pad 17, 18 in order to clamp only the respective clamping bar 11, 12 firmly between the respective clamping pad 17, 18 and the respective clamping jaw 19, 20, while the blanket material 13 is located completely outside the clamping devices 6 and 7. In other words, when the clamping bars 11 and 12 are firmly clamped, the blanket material 13 is located either between the clamping pad 17 and the clamping jaw 19 or between the clamping pad 18 and the clamping jaw 20.

Only the clamping device 6 assigned to the start of the print includes two cylindrical register pins 21 and 22, which engage, through register cut-outs 23 and 24, with the clamping bar 11 clamped in and projecting beyond a supporting surface for the clamping bar 11 on the clamping pad 17. The register pin 21 rests on the approximately semicircular register cut-out 23, along the inner edge of the latter, and the register pin 22, which is formed like the register pin 21, contacts the inner wall of the rectangular register cut-out 24 only at a tangential point, as can be seen in FIG. 2. In order to achieve such a contact, the width of the cut-out 24 is somewhat greater than the diameter of the cut-out 23, and the diameter of the pin 22 can also be somewhat smaller than the diameter of the pin 21.

The rubber blanket 5 is clamped onto the cylinder 4 in the following manner:

Initially, the rubber blanket 5 is inserted into the machine 1, the clamping bar 11 being placed with one flat side thereof onto the clamping pad 17 disposed on the cylinder 4, and being displaced on the pad 17 until the register pins 21 and 22 make contact in the register cut-outs 23 and 24. The clamping jaw 19 is then pressed onto the other flat side of the clamping bar 11 by an otherwise on-illustrated eccentric shaft so that the clamping bar 11 is firmly held, and the in-register position of the leading end of the rubber blanket 5 is fixed.

A pressure roller 25 is then set against or into engagement with the blanket material 11, and the cylinder 4 is set into rotation, so that the pressure roller 25 rolls on the blanket material 13 from the start of the print in a direction towards the tail end of the print and, as a result, tautens the blanket material 13 and places it smoothly from the start to the tail end thereof onto the cylinder 4.

After the pressure roller 25 has reached the tail end of the print, the clamping bar 12 is placed on the clamping pad 18 disposed on the cylinder 4 in the alignment resulting from the rubber blanket 5 being pulled onto the cylinder 4, and this alignment is fixed by closing the clamping device 7 The clamping device 7, which otherwise corresponds in the construction thereof to the clamping device 6, does not have any register pins, and the clamping bar 12 is formed without register cut-outs, which are required only for the leading end and not for the tail end of the rubber blanket 5. The clamping devices 6 and 7 are then adjusted towards one another, thereby tautening the rubber blanket 5. In this regard, the force flow of the tensioning or tautening force flows from the clamping device 7, over the clamping bar 12, further over a flat bond 26, further over the blanket material 13, further over a further bond 27 and ultimately over the clamping bar 11 to the clamping device 6. It has been shown that adhesive bonds 26 and 27 produced with a suitable adhesive, for example No. 588 from 3 M, i.e., the Minnesota Mining and Manufacturing Co., exhibit a sufficiently high shear strength of $\geqq 4$ Newtons per square millimeter and withstand loadings of this type over a long service life, even without the bonded parts 11, 13 and 12, 13, respectively, being pressed together, which is conceivable as distinguished from the exemplary embodiment shown under the loading by the clamping devices 6 and 7.

A printing plate 28 forming a register system together with the rubber blanket and the cylinder 4 can be clamped onto the cylinder 4 as required, alternating with the rubber blanket 5. Positioning the printing plate 28 by the register pins 21 and 22, pulling on the printing plate 28 by the pressure roller 25, and firmly clamping the ends of the printing plate in the clamping devices 6 and 7 are performed in the manner already explained hereinbefore with regard to clamping the rubber blanket 5.

For this purpose, the leading end of the printing plate 28 is provided with register cut-outs 30 and 31 (register cut-out 30 hides the register cut-out 31 located behind it in FIG. 1) which, in terms of the shape thereof, correspond to the register cut-outs 23 and 24, the center spacing of the cut-outs 30 and 31, in exactly the same way as that of the register cut-outs 23 and 24, corresponding to a center spacing 29 of the register pins 21 and 22.

In order for the ends of the printing plate 28 to be insertable into clamping devices 6 and 7 which open only slightly, the ends of the printing plate 28 are tapered over a width corresponding approximately to the overlap width 15 to a thickness corresponding approximately to the thickness of the clamping bars 11 and 12. The printing plate 28 is a flexographic printing plate having a printing relief layer 32 bearing the printed image and being tapered in the region of the ends of the plate during the development process of the printing image. If the relief layer 32 is a photo polymer layer, the development of the printing image and the tapering of the ends of the plate can be performed by a washing process. If the printing plate 28 is additionally a multilayer plate, the relief layer 32 is removable completely down to a stable carrier layer 33. The register cut-outs 30 and 31, before the use thereof for the in-register positioning of the printing plate 28 in the clamping device 6, have already been used for the in-register positioning of the printing plate 21 during the imaging or image-setting process preceding the washing process and producing the printed image, which was latent only before the washing process.

We claim:

1. A method of aligning a rubber blanket configuration relative to a clamping device having register pins, for clamping the rubber blanket configuration onto a cylinder, which comprises:

providing the rubber blanket configuration with a blanket material and a clamping bar having substantially u-shaped register cut-outs formed therein;

inseparably connecting the clamping bar to the blanket material; and bringing the substantially u-shaped register cut-outs formed in the clamping bar into contact with the register pins of the clamping device when the clamping device has been applied to the cylinder.

2. A rubber blanket configuration, comprising:

a rubber blanket having a blanket material and a clamping bar with substantially u-shaped register cut-outs formed therein;

said blanket material having an upperside layer and an underside layer; and said clamping bar being disposed only on said underside layer.

3. The rubber blanket configuration according to claim 2, wherein said clamping bar is disposed only on an underside of said underside layer.

4. The rubber blanket configuration according to claim 2, wherein said clamping bar projects beyond an edge of the blanket material.

5. The rubber blanket configuration according to claim 4, wherein said edge is a leading edge of the blanket material.

6. The rubber blanket configuration according to claim 2, wherein the register cut-outs are formed only in said clamping bar.

7. The rubber blanket configuration according to claim 2, including a sealing substance provided in at least one corner angle between the blanket material and said clamping bar.

8. An assembly, comprising:

a rubber blanket configuration having a blanket material;

said rubber blanket configuration having a clamping bar with substantially u-shaped register cut-outs formed therein; and a clamping device fastening said rubber blanket configuration to a cylinder, said clamping device gripping only said clamping bar.

9. A register system, comprising:

a cylinder having register pins;

a flexographic printing plate with substantially u-shaped register cut-outs formed therein; and a rubber blanket configuration having structures defining further substantially u-shaped register cut-outs disposed in the rubber blanket configuration and corresponding to said substantially u-shaped register cut-outs of said printing plate;

said substantially u-shaped register cut-outs and said further substantially u-shaped resister cut-outs both corresponding to said register pins of said cylinder.

10. A printing machine, comprising;

a rubber blanket configuration including a blanket material and a clamping bar having substantially u-shaped register cut-outs formed therein;

said blanket material having an upperside layer and an underside layer; and said clamping bar being disposed only on said underside layer.

11. A varnishing machine, comprising:

a rubber blanket configuration including a blanket material and a clamping bar having substantially u-shaped register cut-outs formed therein;

said blanket material having an upperside layer and an underside layer; and said clamping bar being disposed only on said underside layer.

12. An assembly, comprising:

a rubber blanket configuration having a blanket material;

said rubber blanket configuration having a clamping bar with substantially u-shaped register cut-outs formed only in said clamping bar and said clamping bar projecting beyond an edge of said blanket material; and a clamping device fastening said rubber blanket configuration to a cylinder, said clamping device gripping only said clamping bar.

13. A method of aligning a rubber blanket configuration relative to a clamping device having register pins, for clamping the rubber blanket configuration onto a cylinder, which comprises:

providing a blanket material;

providing at least one clamping bar;

forming substantially u-shaped register cut-outs in the at least one clamping bar; and producing the blanket configuration by inseparably connecting the at least one clamping bar to the blanket material, for later installation of the blanket configuration onto the cylinder by bringing the substantially u-shaped register cut-outs formed in the at least one clamping bar into contact with the register pins of the clamping device when the clamping device has been applied to the cylinder.

14. A method of aligning a rubber blanket configuration relative to a clamping device having register pins, for clamping the rubber blanket configuration onto a cylinder, which comprises:

obtaining the rubber blanket configuration including at least one clamping bar with substantially u-shaped register cut-outs formed therein and a blanket material inseparably connected to the at least one clamping bar; and installing the blanket configuration onto the cylinder by bringing the substantially u-shaped register cut-outs formed in the at least one clamping bar into contact with the register pins of the clamping device when the clamping device has been applied to the cylinder.

* * * * *